US007086635B1

(12) United States Patent
Drapeau

(10) Patent No.: US 7,086,635 B1
(45) Date of Patent: Aug. 8, 2006

(54) FABRIC HANGER METHOD AND SYSTEM

(76) Inventor: Raoul East Drapeau, 2410 Luckett Ave., Vienna, VA (US) 22180

( * ) Notice: Subject to any disclaimer, the term of this patent is extended or adjusted under 35 U.S.C. 154(b) by 0 days.

(21) Appl. No.: 10/906,915

(22) Filed: Mar. 11, 2005

(51) Int. Cl.
*B42F 13/00* (2006.01)

(52) U.S. Cl. ..... 248/339; 24/341; 206/480; 223/87

(58) Field of Classification Search ..... 248/339, 248/340, 316.1, 316.7; 211/45, 124; 223/87, 223/90, 91, 93, 96; 24/341; 206/480, 495
See application file for complete search history.

(56) References Cited

U.S. PATENT DOCUMENTS

| | | | | | |
|---|---|---|---|---|---|
| 646,771 | A | * | 4/1900 | Tyler | 223/96 |
| 1,498,204 | A | * | 6/1924 | Ruchie | 38/71 |
| 2,215,139 | A | * | 9/1940 | Uhlmann | 24/543 |
| 2,419,723 | A | * | 4/1947 | Marck | 223/96 |
| 2,440,066 | A | * | 4/1948 | Bell | 223/96 |
| 2,440,951 | A | * | 5/1948 | Hrachovina | 223/91 |
| 2,555,672 | A | * | 6/1951 | Baugh | 223/96 |
| 2,920,801 | A | * | 1/1960 | Batts | 223/96 |
| 2,964,197 | A | * | 12/1960 | Wallace | 211/45 |
| 3,054,541 | A | * | 9/1962 | Wilson | 223/96 |
| 3,085,726 | A | * | 4/1963 | Ralph | 223/91 |
| 3,755,859 | A | * | 9/1973 | Solari | 223/87 |
| 3,808,710 | A | * | 5/1974 | Ackerman et al. | 434/75 |
| 4,193,504 | A | | 3/1980 | Berkowitz | 211/119 |
| 4,202,451 | A | | 5/1980 | Berkowitz | 206/526 |
| 4,234,088 | A | | 11/1980 | Berkowitz | 206/408 |
| 4,266,677 | A | * | 5/1981 | Dewsnap | 211/45 |
| 4,454,969 | A | * | 6/1984 | Huth | 223/96 |
| 4,754,566 | A | | 7/1988 | Gordon | 40/603 |
| 5,020,704 | A | * | 6/1991 | Kent | 223/96 |
| 5,082,153 | A | | 1/1992 | Duester et al. | 223/96 |
| 5,097,996 | A | | 3/1992 | Chen | 223/91 |
| 5,178,306 | A | | 1/1993 | Petrou | 223/96 |
| 5,183,191 | A | | 2/1993 | Garrison et al. | 223/96 |
| 5,318,174 | A | | 6/1994 | Zoroufy | 211/45 |
| 5,361,948 | A | * | 11/1994 | Batts | 223/96 |
| D355,788 | S | | 2/1995 | Irvin | |
| 5,546,638 | A | | 8/1996 | Chiodaroli | 24/67.9 |
| 5,890,634 | A | * | 4/1999 | Zuckerman et al. | 223/96 |
| 5,908,184 | A | | 6/1999 | Scoble | 248/316.3 |
| 5,915,605 | A | | 6/1999 | Blanchard | 223/96 |
| 6,058,580 | A | * | 5/2000 | Shih | 24/511 |

(Continued)

FOREIGN PATENT DOCUMENTS

| | | | |
|---|---|---|---|
| DE | 4302346 | A1 * | 3/1994 |
| DE | 20317453 | U1 * | 4/2005 |

*Primary Examiner*—Korie Chan

(57) ABSTRACT

An improved hanger for storage and display of material such as fabric and the like. The hanger includes opposed panel sides interconnected at an upper spine portion. Fabric or other material is placed between the panels and is retained by a unique set of clips applied externally of the panel sides combined with and high-friction components including friction plates or clips with friction nibs positioned within the panels. A resilient spring clip is moved into a gripping position so as to impart pressure to the assemblage. Embodiments of the friction plates include a first U-shaped bracket element designed to be friction fitted along a side of one of the panels, while a second U-shaped bracket element is configured to be friction fitted along an opposing panel. The first bracket includes a detent arrangement for retaining the spring clip in a gripping position. The second bracket includes a spring clip retaining arrangement so as to prevent detachment of the spring clip when it is moved to its release position.

12 Claims, 6 Drawing Sheets

U.S. PATENT DOCUMENTS 6,450,471 B1 9/2002 Wear ..... 248/489
6,453,518 B1 9/2002 Adams et al. ..... 24/67.9
6,547,200 B1 * 4/2003 Dilworth ..... 248/316.5
6,609,640 B1 8/2003 Bokmiller ..... 223/93

* cited by examiner

FABRIC HANGER METHOD AND SYSTEM

FIELD OF THE INVENTION

This invention relates to an improvement to a method for holding samples of fabric for display.

DESCRIPTION OF RELATED ART

Existing fabric hanging systems and devices used in retail and other establishments where samples of fabric are displayed have important disadvantages. One common system to which this invention is an improvement, uses simple clamshell-like devices usually made of cardboard, with a first and second, or front and back, holding panels joined along the top, and the bottom portions of whose sides or panels close around one end of the sample. The sides are then held in place at their lower edges by several bolts and barrel nut sets (sometimes called Chicago binding posts) that pass through the aligned holes in the sides and fabric.

While effective at displaying and holding the sample, this approach has an important disadvantage for the customer or store clerk, in that it is time-consuming and difficult to remove the sample to unfold it for inspection and then to reassemble it. Further, the reassembly can be time-consuming, since it requires lining up the existing holes in the fabric, which are often not well-defined, with the bolts and nuts and with the holes in the sides. This inconvenience is particularly vexing when the fabric has several folds and thus numerous holes, all of which must be exactly lined up to reassemble the hanger.

Further, when these holders are initially prepared, holes must be punched in the fabric, a process that can be difficult to accomplish with some fabrics as well as time-consuming. The current invention avoids these disadvantages by not requiring punching holes in the fabric to accept fasteners, retains the advantage in the prior art hanger of a useful promotional surface and provides the important advantage of easy removal of the fabric for inspection.

One style of fabric hanger that eliminates the bolt/nut sets and the inconvenience they cause is typified by Berkowitz (U.S. Pat. Nos. 4,193,504, 4,202,451 and 4,234,088). However, this design uses bent wire with long, sharp points that pierce the fabric. In addition to being dangerous, it does not have the promotional surface characteristic of the prior art hanger to which the current invention is an improvement.

Another clamping device is shown in Gordon (U.S. Pat. No. 4,754,566), but is not suitable for all fabrics due to its requiring that the plane of the fabric be bent and fit between a wedging member and a receiving channel.

There are numerous spring-loaded unitary holders for sheet material that could be adapted for use as fabric hangers such as Adams et al (U.S. Pat. No. 6,453,518) and Wear (U.S. Pat. No. 6,450,471), but all have the characteristic that they are relatively-complicated mechanical designs, derive the force holding the sheet material from a component of the structure itself and do not have a large, flat surface area for promotional purposes.

Chiodaroli (U.S. Pat. No. 5,546,638), Dilworth (U.S. Pat. No. 6,547,200) and Irvin (U.S. D355,788) are typical of clamping devices suitable for fabric hangers that incorporate frictional surfaces into the hanger structure itself, and a form of clasp to secure the sides, but their design would be unsuited for the much thinner sides of the prior art hanger.

There are numerous fabric hangers that consist of spring-loaded clamps on either end of a garment hanger (e.g. Chen U.S. Pat. No. 5,097,996, Duester et al U.S. Pat. No. 5,082, 153, Garrison et al U.S. Pat. No. 5,183,191, Blanchard U.S. Pat. No. 5,915,605, Petrou U.S. Pat. No. 5,178,306 and Bokmiller U.S. Pat. No. 6,609,640). However in all cases, the clamps are an integral part of the hanger design and the hanger affords no surface area for promotion. Further, the design of most allows inadvertent release of the hanging fabric sheet by pressing the clamp ends, an occurrence that can easily happen when numerous such hangers are carried in a single rack.

The last type of relevant prior art device cited is that of individual clamping devices that can be used individually or in sets (Scoble U.S. Pat. No. 5,908,184 and Zoroufy U.S. Pat. No. 5,318,174). These are different in nature from the current invention in that they are not an integral component of a two-part clamping system consisting of hinged cardboard leaves and clamps.

There is no commercially-available product known that provides the described improvement to the prior art fabric hanger.

Thus, the prior art, as exemplified above, falls short in terms of providing an effective and wholly satisfactory device for storing and displaying material such as fabric and the like. In other words, despite an array of existing material display and storage devices, there exists a longstanding need for improvements. This need is satisfied by the present invention to be fully and completely described below.

BRIEF SUMMARY OF THE INVENTION

The present invention eliminates the disadvantages of currently existing holders for fabric or other material, which employ punched holes in the material and the use of bolt/nut sets to hold the first and second, or front and back, panel sides in close proximity, retaining the fabric or other material therebetween. While eliminating said disadvantage, the present invention retains the attractive features of this kind of hanger in that it is relatively inexpensive and affords a relatively large and uninterrupted surface on both panel sides that can be used for advertising and product identification purposes.

The present invention solves the problem of inconvenience by essentially retaining the simple hinged cardboard (or similar structural) component with first and second panels interconnected by a spine, and presenting valuable promotional space thereon. These panels further incorporate high-friction components on one or more of the inside surfaces of the panels, near their lower outside edges. This high-friction component can be either incorporated directly into the inner surfaces of the panel sides, such as by molding, or can be a separate component attached to one or more inner surfaces of the panel sides near their lower outside edge.

The surface of such a high-friction component typically consists of numerous small, rough, raised protuberances or nibs, similar to those on a cheese grater. Spring clips or clamps pressing against the outside surface of the panel front and back sides directly over the high-friction components urge the two panel sides toward one another so as to press tightly against the fabric or other material, thus securing it in place through the frictional effect of the raised protuberances or nibs.

With the present invention, the spring clips or clamps can be quickly removed and the panels opened to free the fabric or other material for inspection. When ready to reassemble, the material is simply re-folded (if refolding is necessary), the panels closed over it and the spring clips re-installed.

There are several variations of the spring clip and high-friction components that will be described; all clearly falling within the spirit and scope of the present invention as described and claimed.

DETAILED DESCRIPTION OF THE INVENTION

Figure 1:
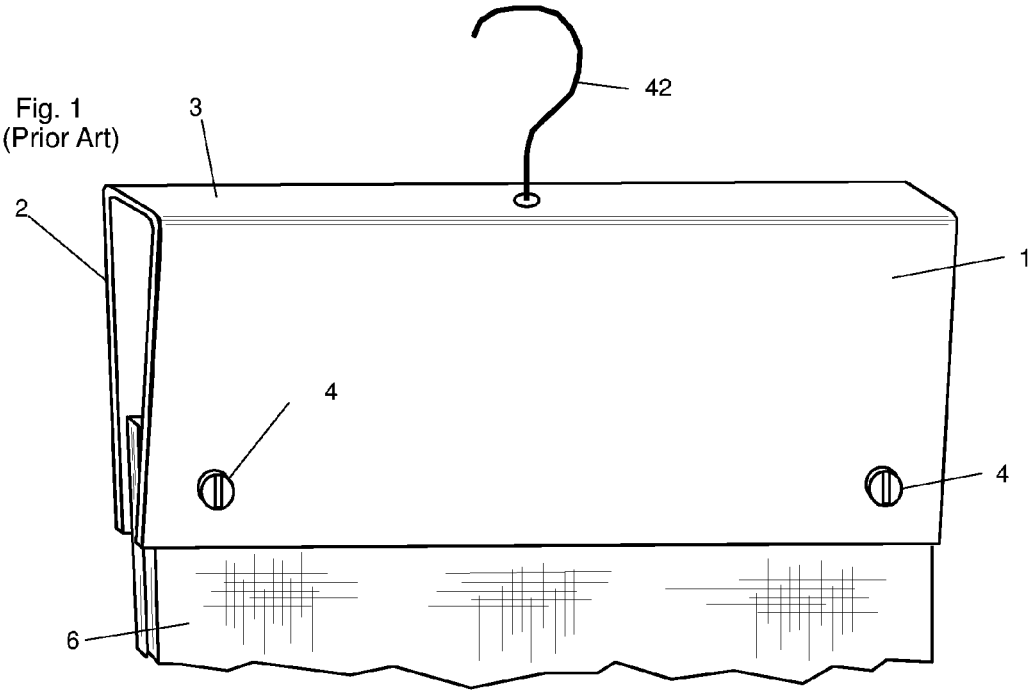
Fig. 1 (Prior Art)
FIG. 1 is designated as prior art and shows a side view of a hanger device for fabric and the like well known in the art, and illustrated in its typically vertical position.

It should be noted that while the present invention, during its use and storage, may be disposed in any number of positions, it is herein described for sake of clarity and simplicity, and without intent to limit claim scope, as viewed in a substantially vertical, hanging orientation as suggested by prior art FIG. 1.

Turning first, to the prior art FIG. 1, it is seen that a typical existing hanger includes a first and second, or front and back, holding panels 1 and 2 respectively, with bottom and lateral edges, and upper and lower panel portions. Said upper portions of the panels are joined at a top or spine portion 3 which also contains a hook 42 for supporting the hanger on a storage rack. Several fasteners consisting of bolts or threaded posts 4 and nuts 7 (shown in FIG. 3) are passed through holes 8 (shown in FIG. 2) punched or otherwise formed in the panels 1 and 2 adjacent the lower ends thereof as viewed in FIG. 1. Typical of this type of hanger, holes also are formed in the material 6 generally in alignment with holes 8. Thus, when bolts 4 and nuts 7 are tightened, they securely hold the fabric or other material. For wide samples of fabric or material, three bolt/nut pairs are commonly used, but for widths up to about 12 inches, two pairs usually suffice.

Figure 2:
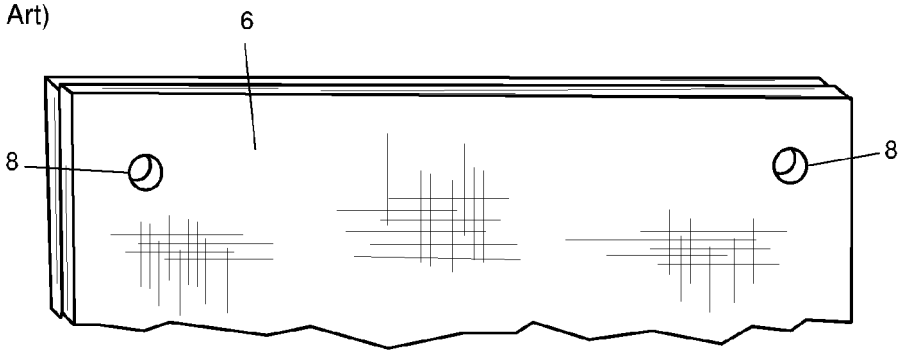
Fig. 2 (Prior Art)
FIG. 2 shows a side view of a material sample in a form generally held in such prior art hanger device, and with holes punched adjacent one end thereof.

FIG. 2 shows a typical fabric sample 6 used in the prior art hanger, with multiple holes 8 punched therethrough. The fabric depicted is assumed to have two folds or layers, but any number of folds that can be accommodated by the throat or grasp of the hanger may be used.

Figure 3:
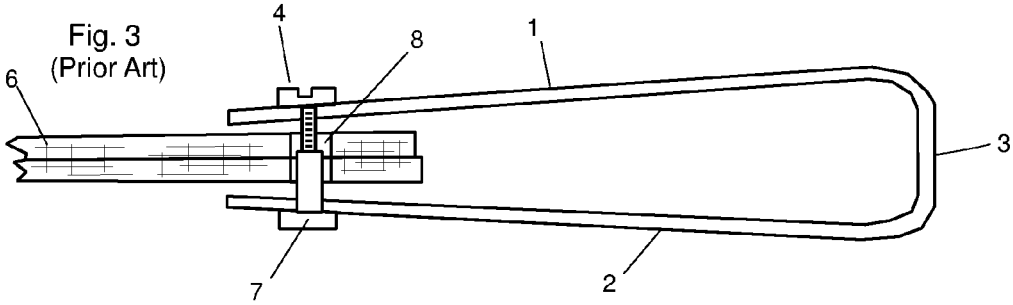
Fig. 3 (Prior Art)
FIG. 3 shows a lateral side view of the prior art material hanger.
Figure 4:
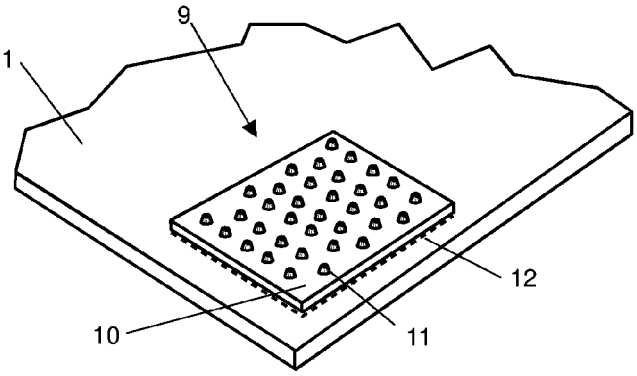
FIG. 4 shows a perspective view of a friction plate with protruding nibs, and positioned within one panel side and adjacent one end or edge thereof.

FIG. 3 is a partial end view of the prior art hanger showing the fabric 6 with hole 8, sides or panels 1 and 2, spine 3 and one bolt/nut pair 4 & 7, respectively. Turning now to the first illustration of the present invention, FIG. 4 shows a friction plate 9 with flat base material 10 and nibs or similar high friction projections or protuberances 11 mounted or otherwise located on the inside surface of one of the panels shown as 1. These nibs will usually be punched in the base material, so as to be sharp and similar in size and nature to those found on a typical kitchen grater (not shown). Optionally, without departing from the scope and spirit of the present invention, the friction plate may be provided with notches similar to those typical of gripping jaws of a pair of pliers. In any case, the friction plate may be characterized generally as presenting a roughened, high-friction gripping surface.

The friction plate is held in place on the inside surface of panel 1 by an adhesive 12, an edge of which may be visible as shown. It may also be held in place by any other convenient means of attachment such as by rivets, screws, staples, stitches, hook and loop fasteners (e.g., Velcro, spot weld, and the like, or integrally formed, molded or machined in the fabricating of said panels.

A friction plate is installed or formed on the inside of one or each of the hanger panels, close to the lower, outside edge of said panel or panels. As discussed above, its purpose is to provide a high level of friction between the enclosed material, e.g., fabric, and the hanger sides or panels particularly in the presence of an external force pressing the panels toward one another, thereby gripping and preventing the fabric from pulling out, even in the absence of screw/nut pairs.

Figure 5:
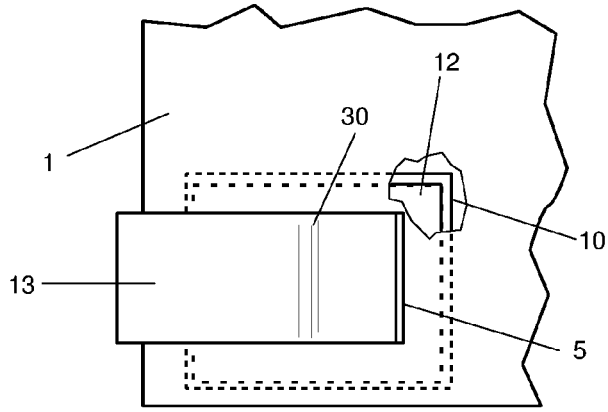
FIG. 5 shows a plan view of a lower, end edge of one panel side of the fabric (or other material) holder of one-embodiment of the present invention with spring clip in place.

FIG. 5 is a top view of the outside of panel 1, showing a spring clip 13 in place in its engaged or gripping position. The spring clip may be opened or spread to such an extent as to encompass both hanger panels 1 and 2, along with the fabric or other material sample enclosed therebetween. When fully seated as shown, said clip imparts the force necessary to tightly engage the friction plate or plates with the fabric or other material and thus prevent the material from slipping. Also in FIG. 5, the underlying friction plate 10 on the opposite surface of the panel, along with a portion of the adhesive 12 that binds said plate to the panel surface is shown in cutaway and phantom lines. An upturned end 5 of the spring clip 13 provides a surface to aid in pushing the clip away to free the sample (see also FIG. 6). The spring clip 13 also has a portion of its lower surface 30 that delivers pressure to said panel 1.

Figure 6:
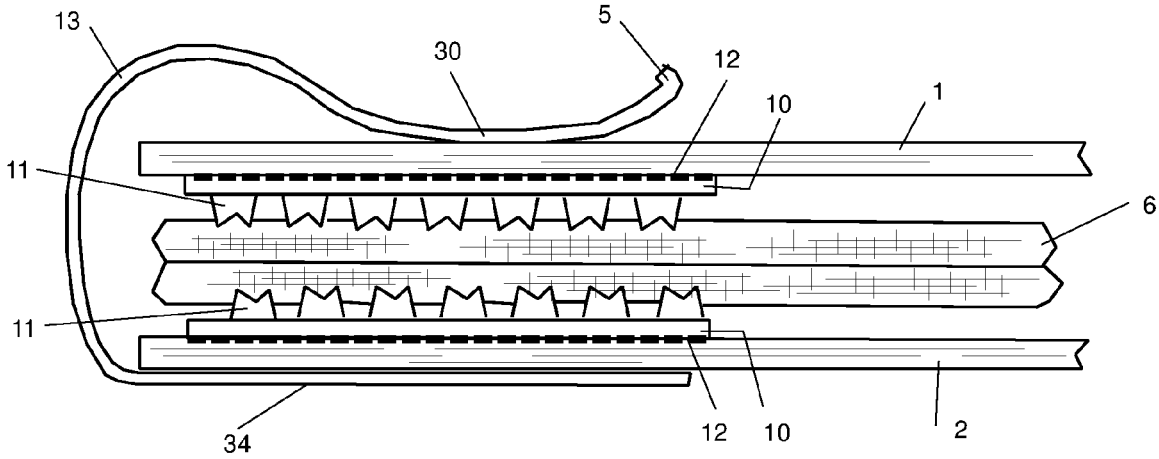
FIG. 6 shows a partial bottom view of the fabric (or other material) holder with friction plates on the inside of both the first and second panel sides and with spring clip in place.

FIG. 6 is a partial bottom view of one lower, outside edge of the current invention. In it, the friction plates 10 with their nibs 11 are attached to the panels 1 and 2 by an adhesive layer 12. Their nibs 11 press against the layers of the fabric 6. The clip 13 has an upper surface with a portion 30 that presents a spring force against panel 1, an upturned portion 5 that provides purchase to remove the spring clip when necessary and a lower, relatively flat surface 34 that lies generally adjacent the other panel 2. While only one design for a spring clip is shown, many other configurations are possible to provide the essential force biasing the panels toward one another.

Figure 7:
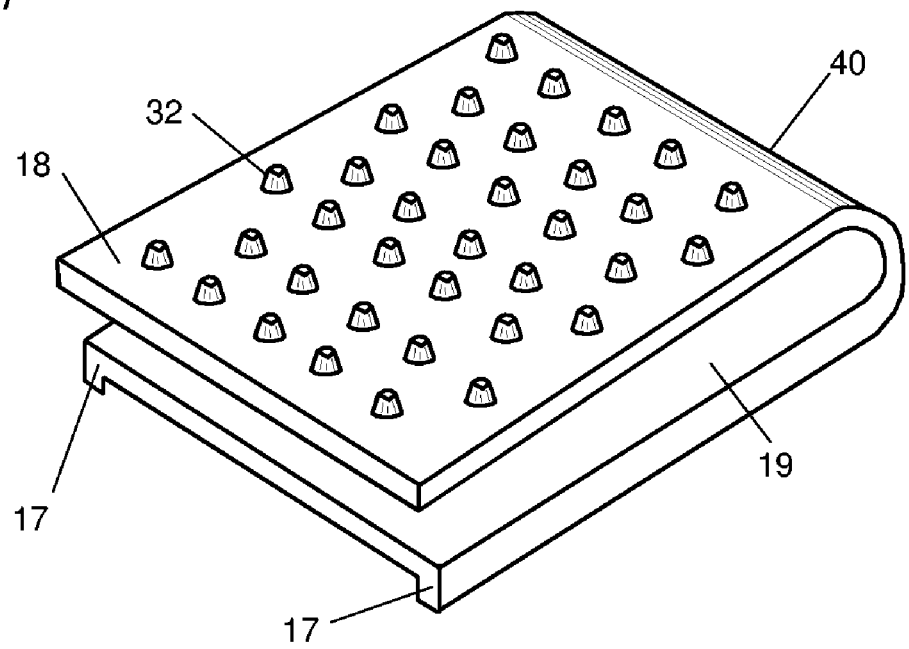
FIG. 7 shows a perspective view of the inside face of a bracket-type receiver friction clip presented as an alternative embodiment of the friction plate bent or otherwise configured into the form of a bracket-type receiver friction clip.

FIG. 7 is a perspective view of the bottom of a receiver friction clip 40, one component of a variation of the current invention, in which one end of the friction plate with nibs 32 has been made longer, and folded over, or otherwise configured, to form a generally U-shaped bracket. This bracket is called the receiver clip here, since it receives the spring clip. In this case, the receiver friction clip consists of a friction plate 18 with nibs 32 and a detent surface 19, so called since it carries a detent in its surface to aid in keeping the spring clip in place. This receiver friction clip is installed along a lateral edge of a first panel of the hanger with its nibs facing inward toward the fabric or other displayed material. The distance between the two inside surfaces 18 and 19 is matched to the thickness of the hanger panels such that when the bracket receiver friction clip is forced into place on a panel, it forms a friction fit and thus will remain in place. The receiver friction clip may also be held in place on a hanger panel by adhesive or riveting. Alternatively, the receiver friction clip may have an initial configuration where its two opposed bracket surfaces are at an acute angle relative to one another, rather than parallel, and that one or both inside surfaces have small sharp protuberances (not shown), such that when pressed toward one another, the two surfaces become parallel and firmly grip the panel. In addition, the receiver friction clip may have raised sides 17, to assist in guiding or keeping the spring clip in place when seated and moved.

Figure 8:
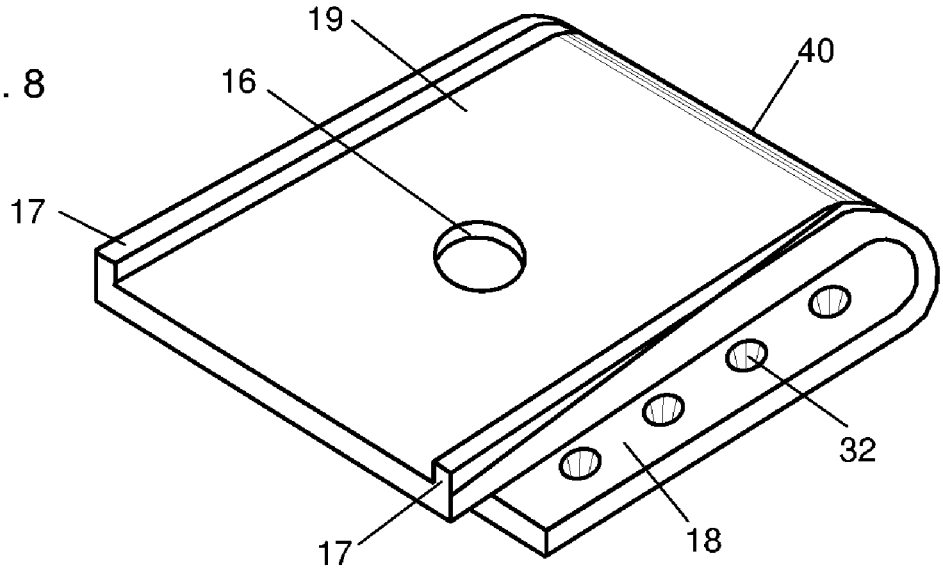
FIG. 8 shows a perspective view of the outside face of the receiver friction clip illustrated in FIG. 7.

FIG. 8 is a perspective view of the top, or opposite side of the same receiver friction clip 40 as shown in FIG. 7. The detent surface 19 has channel sides 17 that guide the spring clip and a hole or depression 16 defined by said surface 19 that provides a detent seat for a matching protrusion on the spring clip (not shown here). Of course, other equivalent detaining elements such as a ridge or hook/latch and the like could be utilized here, as well, without departing from the scope of the claimed invention. Also shown on the friction plate side 18 is the opposite, or concave side, of nibs 32 shown here as relatively hollow deformed protrusions. Again, alternative equivalent configurations would suffice, as for example solid nibs or raised surface nibs and so forth.

Figure 9:
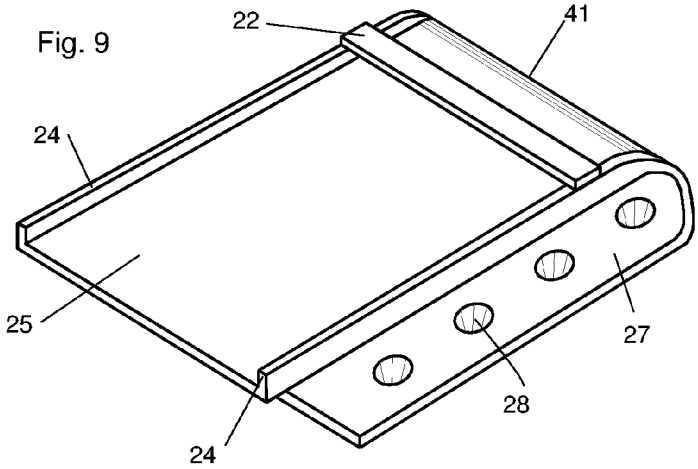
FIG. 9 shows a perspective view of the outside face of a bracket-type retainer friction clip designed to oppose the receiver friction clip, and shown without a spring clip in place.

FIG. 9 is a perspective view of the top or carrier side of the friction retainer clip 41 designed as a second component to oppose the receiver friction clip discussed hereabove. It is called the retainer friction clip, to differentiate from the receiver friction clip since its function is to retain the spring clip when the panels are opened or moved to a release position to release the fabric or other material. Also illustrated as bent or otherwise configured into the form of a bracket-type clip, this retainer clip consists of a base 25, sides 24, and an opposite or friction side 27 containing the nibs 28, whose concave side is shown here. This bracket-type retainer friction clip also is matched to the thickness of the hanger panels such that when it is forced into place on a panel, it forms a friction fit therewith and thus will remain in place. The retainer friction clip may also be held in place on a panel by alternative means as discussed above with respect to its opposing receiver friction clip.

The retainer friction clip is adapted to be installed on the second panel along a lower edge thereof, and with its nibs facing inward towards the fabric, directly opposite the receiver friction clip.

Figure 10:
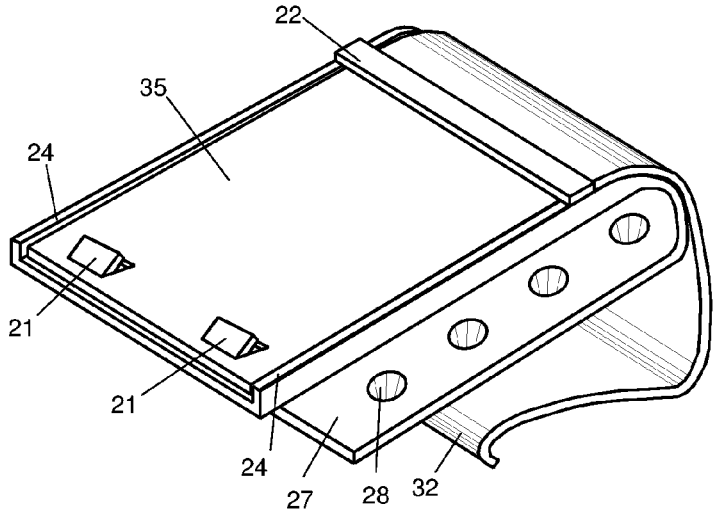
FIG. 10 shows a perspective view of the outside face of the bracket-type retainer friction clip with the spring clip fully engaged in its gripping position but, of course, unattached from said panels and material.

FIG. 10 shows a perspective view of the same U-shaped bracket retainer friction clip of FIG. 9 except that the spring clip 35 is in its fully seated position. Note that neither the hanger panels nor the mating or corresponding receiver friction clip is shown here. The spring clip 35 has one or more stops 21 that engage the bar 22 when the spring clip 35 is moved to its retracted or release position, thus preventing the spring clip from becoming separated from the friction clip. An upturned portion 32 of spring clip 35 provides purchase to remove the spring clip when necessary.

Figure 11:
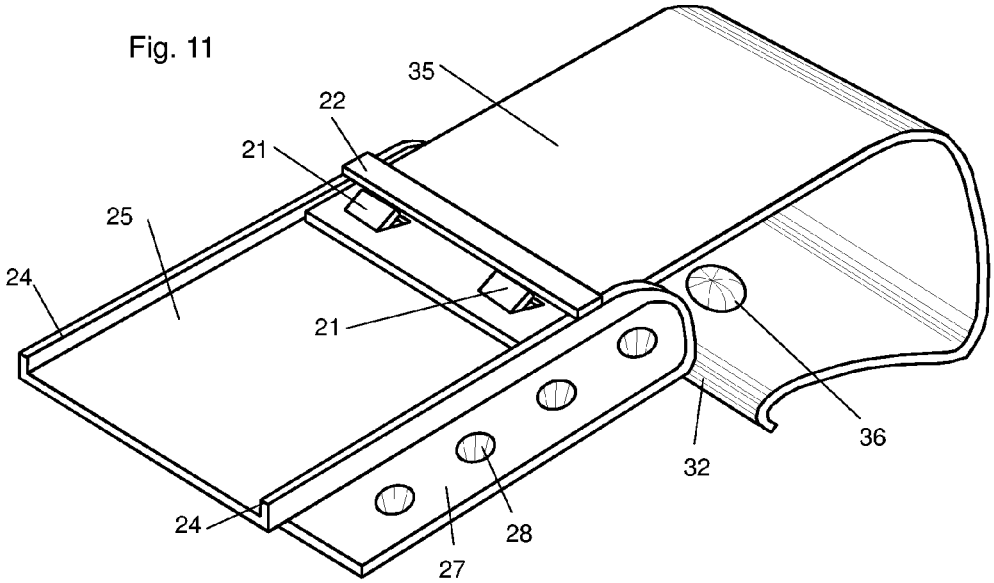
FIG. 11 shows a perspective view of the outside face of the bracket-type retainer friction clip, as illustrated in FIG. 10, but with the spring clip in the retracted or release position.

FIG. 11 is the same as FIG. 10 except that the spring clip 35 is shown in its fully retracted or release position, enabling the sides to be opened and thereby releasing the fabric. A raised portion or dimple 36 of the spring clip 35, serves as a detent by engaging the hole 16 or equivalent latching means in friction clip 19 as shown in FIG. 8.

Figure 12:
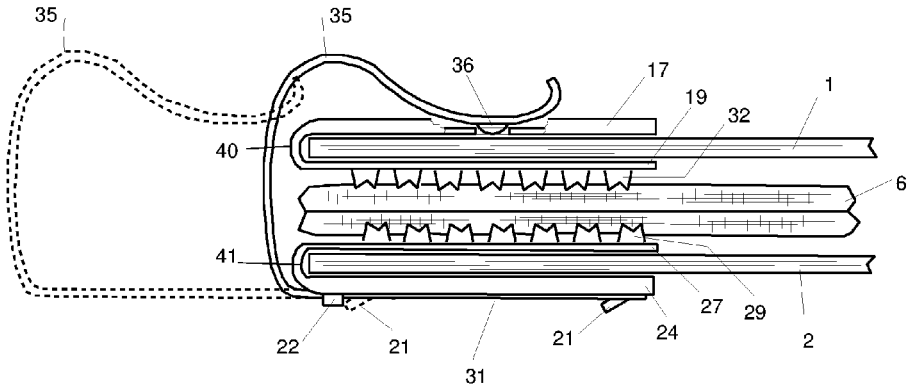
FIG. 12 shows a partial end view of the bottom of the holder with retainer and receiver friction clips and spring clip in gripping position, and with the spring clip illustrated in phantom lines in the retracted or release position.

FIG. 12 is a partial end view of the bottom of the fabric holder with receiver, retainer and spring clips in place. Shown are: the spring 35 in both gripping and release positions (the latter depicted in phantom lines) with detent dimple 36 shown in cutaway and stops 21; retainer clip 41 with friction plate 27 with its nibs 29, channel sides 24 and retainer bar 22; the top or receiver clip 40 with friction plate 19 with sides 17 and nibs 32. Also shown are holder sides or panels 1 and 2 and fabric (or other material) 6.

Figure 13:
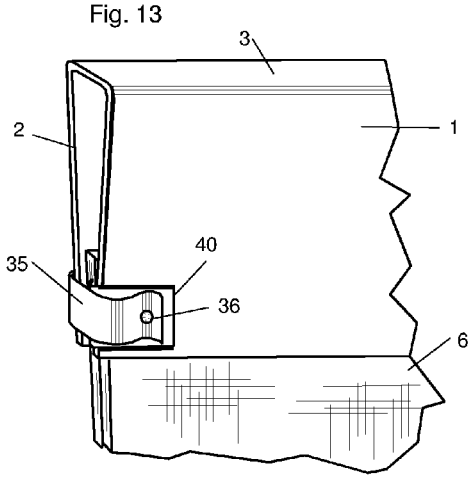
FIG. 13 shows a perspective view of the holder as viewed toward said first, or front, panel and with all clips in place.

FIG. 13 is a perspective view of the holder with front and rear (or first and second) panels 1 and 2 interconnected at spine 3, and featuring the U-bracket type receiver friction clip in position, along with spring clip 35 in its seated or gripping position, pressingly engaging said panels 1 and 2 and fabric 6.

Figure 14:
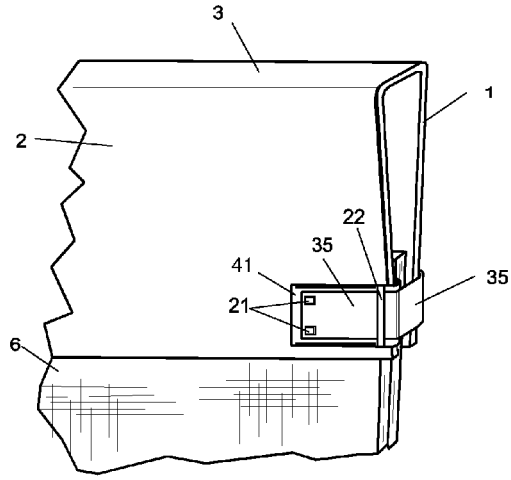
FIG. 14 shows a perspective view of the holder as viewed toward said second, or rear, panel and with all clips in place.

FIG. 14 is a perspective view of the reverse side of the holder illustrated in FIG. 13, further showing the spring clip 35 with stops 21 in its seated position on retainer clip 41 with its retaining bar 22.

Figure 15:
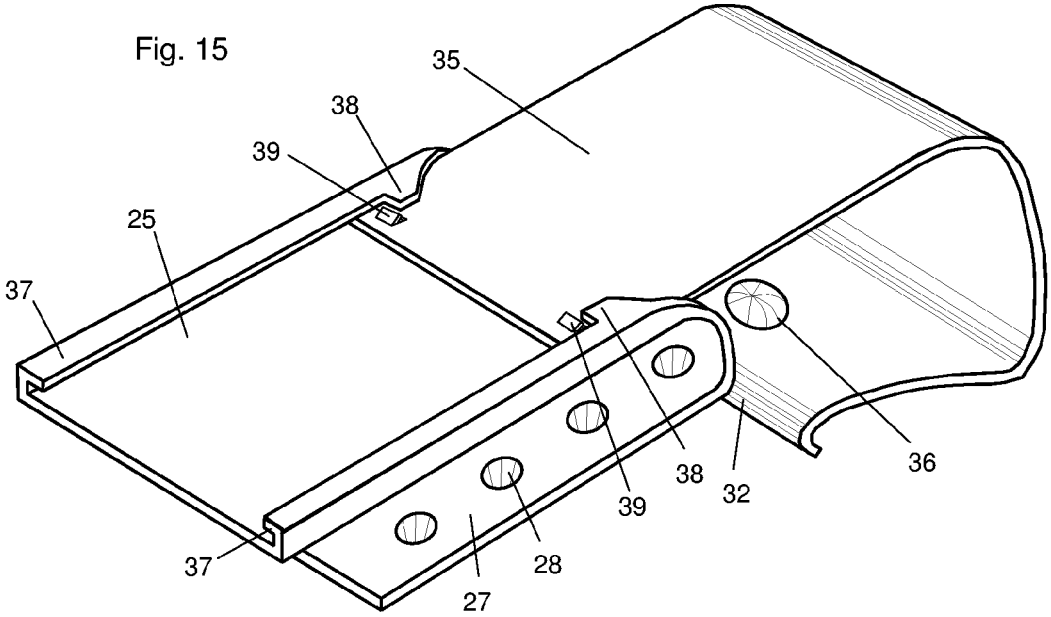
FIG. 15 shows a perspective view of the outside face of a modified embodiment of the bracket-type retainer friction clip with the spring clip in the retracted, or release position.

FIG. 15 shows yet another embodiment of the retainer friction clip. In it, the channel sides 24 of FIG. 11 have been folded or other wise configured or fabricated so as to form a slot to enclose and guide the outside edge of the clip 35 as seen at 37. Further, the function of the bar 22 of FIG. 11 has been replaced by the extensions 38 of the channel sides 37 so that they engage the stops 39, thus preventing the clip 35 from separating from the clip 25.

Figure 16:
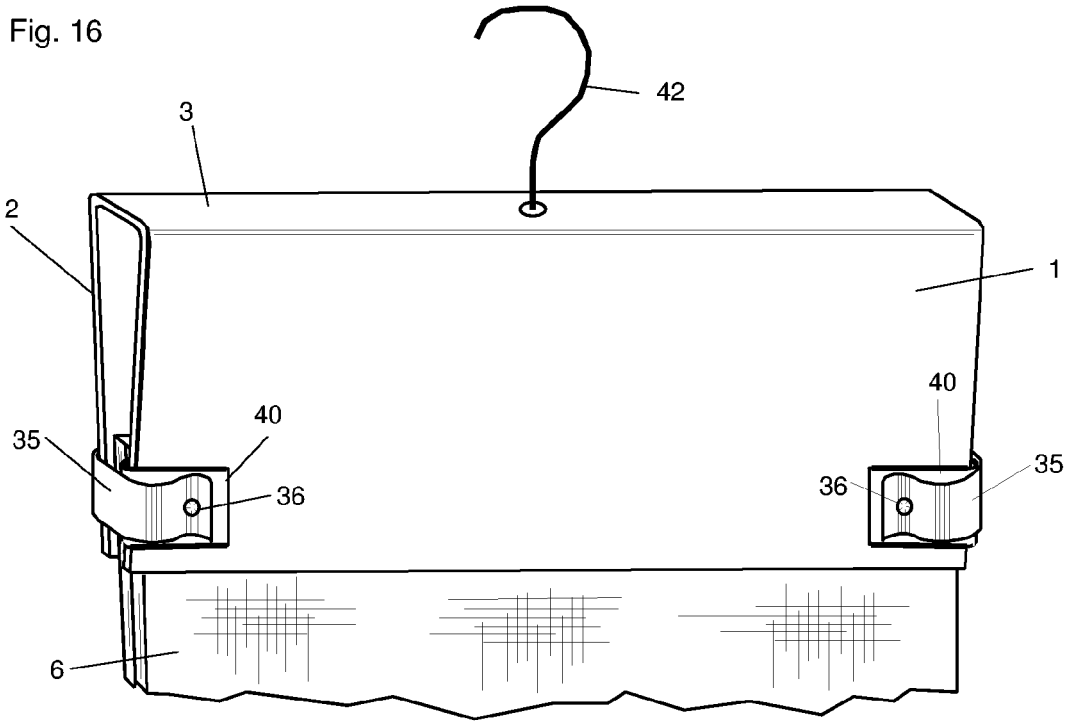
FIG. 16 shows a side view of one embodiment of the present invention with spring clips in place.

FIG. 16 shows a side view of one embodiment of the present invention with holding panels 1 and 2, spine 3, hanging hook 42, spring clips 35, detent dimples 36, receiver clips 40 and material 6.

In use, the storage and display hanger described and claimed herein may have a number of uses: fabric display and merchandising; notebook-type collections of papers and other materials; computer print-out reports; clothing storage and sale display (such as slacks, scarves, skirts and the like); portable and stationary clipboards and a variety of other commercial, private and recreational applications. The device may be fabricated largely from synthetic materials, but may also include natural materials such as pressed fiberboard, layered paper, and the like. The spring and other clip elements may be synthetic, bendable polymeric material or lightweight bendable or resilient metals that display compressive and recovery qualities required for the proper function of the invention device.

As an example of the device in use, it may find application in a fabric store or department where fabric samples are generally stored side-by-side in a display area. Typically, individual or small groupings of such samples are secured for hanging within a vertical array, attached within hanger devices that serve at top-edge bindings for the fabrics. In the present invention, the holder includes at least two panels that cover the upper ends, front and back, of the samples. The holder panels are joined at their upper ends to form a spine element, and near their lower panel edges are resiliently urged urged toward one another by at least one spring clip. Within the panels are mounted at least one friction plate and possibly a plurality of such plates, each having a set of nibs that have high-friction characteristics.

At a location at or near a lower side edge of the hanger (as viewed in its hanging position) a spring clip is provided, and configured so as to deliver a compressive force on each of the panels, first and second, or front and back, such that the fabric, friction plate or plates, and panels are squeezed tightly together, thus binding the fabric in place. Of course, as illustrated, the spring clip may be effectively applied at both lateral edges of the panels. Ample, uninterrupted space is available across the front and back of the panels to place fabric identifiers such as lot number, pattern name, manufacturer source, fiber content and so forth.

The friction plates may take a further unique shape of opposed components including a spring clip guiding and receiver clip and retainer clip, disposed one each lateral side of the panels at or near the lower portion thereof. When a customer wishes to see a particular fabric material, the clerk removes the selected hanger from display and places it in closer view. If the customer wishes to see the fabric in an unfolded and spread-out condition, the spring clips are easily moved to a release position, yet safely retained by the retainer clip, and the fabric is readily removed from the holder. When ready for reassembly, the fabric is suitably folded as necessary and placed within the folder adjacent to the friction plates, and the spring clips are quickly moved to their gripping position, and the hanger unit is returned to storage. No longer will the clerk have to fumble with awkward threaded posts and nuts, and with pressing the posts through the fabric layers.

These descriptions and drawings depict hangers with two discrete sets of friction plates or receiver and retainer clip pairs and spring clips. However, without changing the function of the invention, the width of the friction plates could be altered to encompass a greater portion of the width of the hanger, even to its full extent. Further, one or more friction plates without spring clip could be mounted on the inside surface of either or both of the panels or holder sides at a location removed from the a spring clip, such as near the center of the lower edge of a holder panel or side, to aid in holding the fabric in place under the force derived from the spring clips placed at the ends. In addition, the friction plate function could be integrated into the inside surface of the two sides by molding or similar process, rather than be a separate component, again without changing the scope of the invention.

Upon careful review of the foregoing specification and drawings, it will be evident that this invention is susceptible of many modifications, combinations and alterations which may differ from those specifically set forth. The particular arrangements disclosed are meant to be illustrative only and not limiting as to the scope of the invention which is to be given the full breadth of claims appended hereto and any and all equivalents thereof.

What is claimed is:

1. In a material display system of the type including a material-gripping hanger having first and second holding panels, each having bottom and lateral side edges, said panels joined to one another along a top edge thereof, and at least one releasable connection at a lower portion thereof adapted to interconnect said first and second holding panels so as to confine said material therebetween for storage and display, the improvement comprising:

said holding panels including at least one friction plate disposed on an inner surface of each said first and said second holding panel, each said friction plate including friction nibs positioned to engage said material;

said at least one releasable connection being in the form of a spring clip element disposed along said first and second holding panel lateral side edges, and adapted to be moved from a release position to a gripping position to releasably grip said first and second holding panels along with said friction plates so as to secure said material in place therebetween;

whereby said material may be placed for display between said first and second holding panels and frictionally engaged by said friction plates, and said spring clip may be moved into position to pressingly engage said panels such that said material along with said friction plates is held in place;

said friction plates being further defined as including at least one pair of opposed friction plates in the form of first and second removable friction clips positioned respectively on said first and said second holding panel;

wherein said first removable friction clip is embodied as a receiver friction clip configured generally as a u-shaped bracket frictionally receiving said first holding panel therein;

said receiver friction clip u-shaped bracket includes an outer side and an inner side;

wherein said receiver friction clip bracket outer side further defines a spring detent-receiving seat, and wherein said receiver friction clip bracket inner side includes said friction nibs;

said second removable friction clip is embodied as a retainer friction clip configured generally as a u-shaped bracket frictionally receiving said second holding panel therein;

said retainer friction clip u-shaped bracket includes an outer side and an inner side;

wherein said retainer friction clip bracket outer side includes thereon at least one spring clip retainer element for limiting movement of said spring clip element when in said release position, and wherein said retainer friction clip bracket inner side includes said friction nibs;

said spring clip element is configured to have a contoured engagement surface with a projecting detent element thereon adapted to reside within said detent receiving seat so as to releasably latch said spring clip element in said gripping position relative to said first holding panel;

said spring clip element is further configured to have a relatively flat engagement surface disposed adjacent said second holding panel, and further including at least one outwardly projecting stop element adapted to engage said retainer element when said spring clip element is moved from said gripping position to said release position;

whereby said spring clip element may be moved to a release position by a sliding motion limited by engagement of said spring clip retainer element and said projecting stop element, and may be moved to and latched in a gripping position where said first and second holding panels and said nibs are releasably pressed against the material.

2. The display system of claim 1, wherein said outer side of said receiver friction clip bracket includes raised channel sides along each lateral edge thereof;

said channel sides are substantially parallel and form a guide for movement of said spring clip element.

3. The display system of claim 1, wherein said outer side of said retainer friction clip includes raised channel sides along each lateral edge thereof;

said channel sides are substantially parallel and form a guide for movement of said spring clip element.

4. The display system of claim 3, wherein said spring clip retainer element is an elongated element interconnecting said channel sides of said outer side of said retainer friction clip;

said elongated element is adapted to engage said at least one outwardly projecting stop element when said spring clip element is moved from said gripping position to said release position.

5. The display system of claim 3, wherein said at least one spring clip retainer element is defined as an extension of at least one of said channel sides;

said extension is adapted to engage said at least one outwardly projecting stop element when said spring clip element is moved from said gripping position to said release position.

6. The display system of claim 4, wherein said channel sides are formed as slots adapted to enclose edge portions of said spring clip element as it is moved from said gripping position to said release position.

7. A storage and display system for materials, said system comprising:

a material holding unit having first and second holding panels, each said panel having an upper portion and bottom portion, and further defined by bottom and lateral side edges;

said panels are joined at their upper portions defining a spine segment;

a hanger element forming a part of said system and adapted to suspend said system during storage, and at least one releasable connection at a lower portion thereof adapted to interconnect said first and second holding panels so as to confine said material therebetween for storage and display;

said holding panels including at least one friction plate disposed on the inner surface of each said first and said second holding panel, each said friction plate including friction nibs adapted to engage said materials;

said at least one releasable connection being in the form of a spring clip element disposed along said first and second holding panel lateral side edges, and adapted be moved from a release position to a gripping position to releasably grip said first and second holding panels along with said friction plates so as to secure said material in place therebetween;

such that said material to be displayed and stored may be positioned between said first and second holding panels and frictionally engaged by said friction plates, and said spring clip element may be moved into position to pressingly engage said panels so that said material along with said friction plates are held in place;

said at least one friction plate disposed on the inner surface of each said first and said second holding panel is further defined as including at least one pair of opposed friction plates in the form of first and second removable friction clips;

wherein said first removable friction clip is embodied as a receiver friction clip configured as a generally u-shaped bracket adapted to frictionally receive said first holding panel therein;

said receiver friction clip generally u-shaped bracket includes an outer side and an inner side;

wherein said receiver friction clip bracket outer side defines a spring detent-receiving seat, and wherein said receiver friction clip bracket inner side includes said friction nibs;

said second removable friction clip is embodied as a retainer friction clip configured as a generally u-shaped bracket adapted to frictionally receive said second holding panel therein;

said retainer friction clip generally u-shaped bracket includes an outer side and an inner side;

wherein said retainer friction clip bracket outer side includes thereon at least one spring clip retainer element for limiting movement of said spring clip element when in said release position, and wherein said retainer friction clip bracket inner side includes said friction nibs;

said spring clip element is configured to have a contoured engagement surface with a projecting detent element thereon adapted to seat reside within said detent receiving seat so as to releasably latch said spring clip element in said gripping position relative to said first holding panel;

said spring clip element is further configured to have a relatively flat engagement surface disposed adjacent said second holding panel, and further including at least one outwardly projecting stop element adapted to engage said retainer element when said spring clip element is moved from said gripping position to said release position;

whereby said spring clip element may be moved to a release position by a sliding motion limited by engagement of said spring clip retainer element and said projecting stop element, and said spring clip element may be moved to and latched in a gripping position where said first and second holding panels and said nibs are releasably pressed against the material.

8. The display system of claim 7, wherein said outer side of said receiver friction clip bracket includes raised channel sides along each lateral edge thereof;

said channel sides are substantially parallel and form a guide for movement of said spring clip.

9. The display system of claim 7, wherein said outer side of said retainer friction clip includes raised channel sides along each lateral edge thereof;

said channel sides are substantially parallel and form a guide for movement of said spring clip.

10. The display system of claim 9, wherein said spring clip retainer element is an elongated element interconnecting said channel sides of said outer side of said retainer friction clip;

said elongated element is adapted to engage said at least one outwardly projecting stop element when said spring clip element is moved from said gripping position to said release position.

11. The display system of claim 9, wherein said at least one spring clip retainer element is defined as an extension of at least one of said channel sides;

said extension is adapted to engage said at least one outwardly projecting stop element when said spring clip element is moved from said gripping position to said release position.

12. A storage and display system for materials, said system comprising:

a material holding unit having first and second holding panels, each said panel having an upper portion and bottom portion, and further defined by bottom and lateral side edges;

said panels are joined at their upper portions defining a spine segment;

a hanger element forming a part of said system and adapted to suspend said system during storage;

at least one releasable connection at a lower portion thereof adapted to interconnect said first and second holding panels so as to confine said material therebetween for storage and display;

said holding panels including at least one friction plate disposed on an inner surface; of each said first panel and second panel;

said at least one releasable connection being in the form of a spring clip element disposed along said first and second holding panel lateral side edges, and adapted to be moved from a release position to a gripping position to releasably grip said first and second holding panels along with said friction plates so as to secure said material in place therebetween;

each said friction plate including friction nibs adapted to engage said materials;

further including said spring clip element disposed along each lateral side edge of said first and second holding panels;

said spring clip element adapted to pressingly engage with said panels when in said gripping position;

said spring clip element is formed so as to have a contoured engagement surface adapted to pressingly engage said first holding panel at a front surface thereof;

said spring clip element is further formed so as to present a relatively flat engagement surface adapted to pressingly engage said second holding panel at a rear surface thereof;

said spring clip element further configured so as to resiliently engage said front and rear panels therebetween when in said gripping position;

said at least one friction plate is further defined as including at least one pair of opposed friction plates in the form of first and second removable friction clips;

wherein said first removable friction clip is embodied as a receiver friction clip configured generally as a generally u-shaped bracket adapted to frictionally receive said first holding panel therein;

said receiver friction clip generally u-shaped bracket includes an outer side and an inner side;

wherein said receiver friction clip bracket outer side defines a spring detent-receiving seat, and wherein said receiver friction clip bracket inner side includes said friction nibs;

said second removable friction clip is embodied as a retainer friction clip configured as a generally unshaped bracket adapted to frictionally receive said second holding panel therein;

said retainer friction clip generally unshaped bracket includes an outer side and an inner side;

wherein said retainer friction clip bracket outer side includes thereon at least one spring clip retainer element for limiting movement of said spring clip when in said release position, and wherein said retainer friction clip bracket inner side includes said friction nibs;

said spring clip element is configured to have a contoured engagement surface with a projecting detent element thereon adapted to reside within said detent receiving seat so as to releasably latch said spring clip element in said gripping position relative to said first holding panel;

said spring clip element is further configured to have a relatively flat engagement surface disposed adjacent said second holding panel, and further including at least one outwardly projecting stop element adapted to engage said retainer element when said spring clip element is moved from said gripping position to said release position;

said first outer side of said receiver friction clip bracket includes raised channel sides along each lateral edge thereof;

said channel sides are substantially parallel and form a guide for movement of said spring clip;

said first outer side of said retainer friction clip includes additional raised channel sides along each lateral edge thereof;

said additional channel sides are substantially parallel and form a guide for movement of said spring clip;

said at least one spring clip retainer element is defined as an extension of at least one of said additional channel sides;

said extension is adapted to engage said at least one outwardly projecting stop element when said spring clip element is moved from said gripping position to said release position whereby said material to be displayed and stored may be positioned between said first and second holding panels so as to be frictionally engaged by the nibs of said at least one friction plate, and said spring clip may be moved to and latched in a gripping position where said first and second holding panels and said nibs are releasably pressed against the material, and said spring clip element may be moved to a release position by a sliding motion limited by engagement of said at least one spring clip retainer element, whereupon said material may be removed from said display and storage device.

* * * * *